US006925926B2

(12) United States Patent
Weinberger et al.

(10) Patent No.: US 6,925,926 B2
(45) Date of Patent: Aug. 9, 2005

(54) PUMP CYLINDER LOCK

(75) Inventors: Mark T. Weinberger, Mounds View, MN (US); Michael J. Sebion, Apple Valley, MN (US)

(73) Assignee: Graco Minnesota Inc, Minneapolis, MN (US)

( * ) Notice: Subject to any disclaimer, the term of this patent is extended or adjusted under 35 U.S.C. 154(b) by 26 days.

(21) Appl. No.: 10/481,108

(22) PCT Filed: Jun. 13, 2002

(86) PCT No.: PCT/US02/18886

§ 371 (c)(1),
(2), (4) Date: Dec. 17, 2003

(87) PCT Pub. No.: WO03/001034

PCT Pub. Date: Jan. 3, 2003

(65) Prior Publication Data

US 2004/0149126 A1 Aug. 5, 2004

Related U.S. Application Data

(60) Provisional application No. 60/299,518, filed on Jun. 20, 2001.

(51) Int. Cl.[7] ..... F01B 29/00

(52) U.S. Cl. ..... 92/128; 403/359.5

(58) Field of Search ..... 92/128, 165 PR; 403/359.5, 359.6; 411/190, 192, 195, 315, 418

(56) References Cited

U.S. PATENT DOCUMENTS

| | | | | |
|---|---|---|---|---|
| 181,166 A | | 8/1876 | Halderman et al. | |
| 4,462,638 A | * | 7/1984 | DenBesten et al. | 411/300 |
| 5,033,433 A | | 7/1991 | Churchill et al. | 123/506 |
| 5,033,443 A | * | 7/1991 | Kato et al. | 123/506 |
| 5,064,354 A | * | 11/1991 | Robertson et al. | 92/128 |
| 5,495,902 A | | 3/1996 | Hailey et al. | 175/296 |

* cited by examiner

*Primary Examiner*—Thomas E. Lazo
(74) *Attorney, Agent, or Firm*—Douglas B. Farrow

(57) ABSTRACT

A device that eliminates the need for torque, usually applied by large tools, in the assembly or maintenance of pumps. This device connects the cylinder (7) and upper housing (5) of a pump using a simple locking pin (9) that inserts through the upper housing (5) of the pump and along the flat (7*a*) on the pump cylinder (7). The cylinder (7) inserts into the upper housing (5) until the holes (11) for the pin are (9) aligned. Upon alignment, the locking pin (9) is inserted through both components and locked, thus connecting them.

1 Claim, 1 Drawing Sheet

PUMP CYLINDER LOCK

TECHNICAL FIELD

This application is a 371 of PCT/US02/18886 filed Jun. 13, 2002, which claims benefit of U.S. Application Ser. No. 60/299,518, filed Jun. 20, 2001.

BACKGROUND ART

In the past large tools were required to apply sufficient torque in the course of assembling and repairing pumps. When a pump needed repair, maintenance personnel would need to use inconvenient and cumbersome tools to separate the pump lower from the air motor or other reciprocating power source.

DISCLOSURE OF THE INVENTION

This invention eliminates the need for such large torque tools. The pump cylinder is assembled into the corresponding cavity in the upper housing. The pump cylinder has a flat which is aligned with the alignment holes in the upper housing. The locking pin is slid through the alignment holes and runs alongside the flats on the pump cylinder locking the two components together. The assembler can discern where the correct position for the lower component is by the alignment of the holes on the upper component and the flat on the pump cylinder. Further, the two components can be disassembled by simply removing the locking pin.

Also, the foot valve on the pump can be removed without the danger of the cylinder loosening. Because the cylinder will not rotate with the locking pin in place, it will not loosen due to jarring impact or other common occurrences. This increases safety associated with maintenance and repair of the pump.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
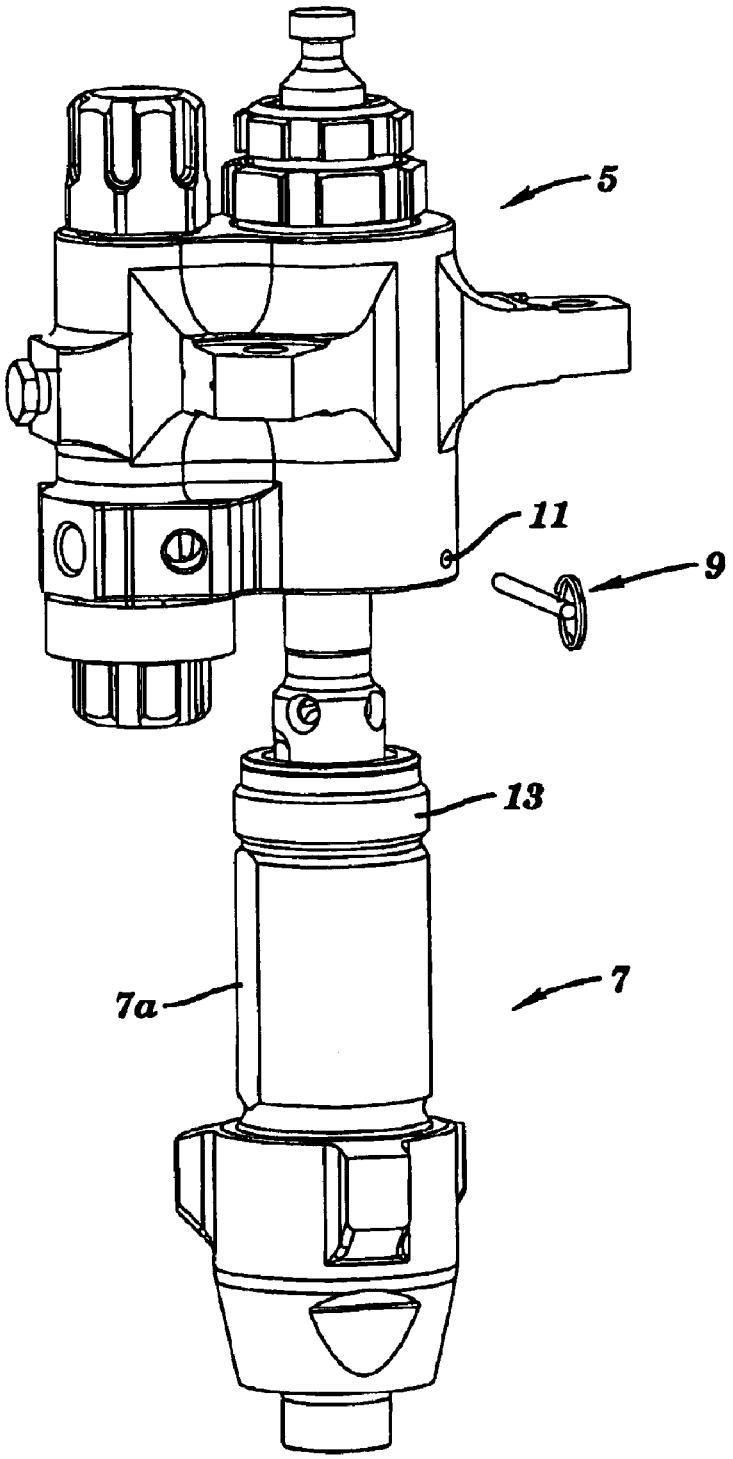
FIG. 1 is a side elevation view of both the upper and lower components of the pump in a disassembled position with the locking pin removed and to the side.

In FIG. 1, the upper housing 5, is above the uninserted cylinder 7. The threaded cylindrical end 13 of the cylinder 7 will be threaded into the upper housing 5 until it bottoms and then backed out until the alignment holes 11 and one of the flats 7*a* of cylinder 13 line up. At that time the locking pin 9 can be inserted into alignment hole 11 and across flat 7*a*, thus locking the upper housing 5 with the cylinder 7. Upon disassembly, the user need only remove the locking pin 9 from the alignment hole 11 and unscrew the cylinder end 13 out of the corresponding cavity in the upper housing 5.

It is contemplated that various changes and modifications may be made to the pump cylinder lock without departing from the spirit and scope of the invention as defined by the following claims.

What is claimed is:

1. A pump comprising an upper housing and a cylinder, said cylinder having an end threaded into said upper housing, an axis of elongation and a locking mechanism, said locking mechanism comprising:

at least one flat on at least a portion of said cylinder;

an aperture in said upper housing normal to said axis of elongation and spaced therefrom; and a pin removably insertable into said aperture to bear against said flat and prevent rotation of said cylinder relative to said upper housing.

* * * * *